US011117369B2

(12) United States Patent
Hasegawa et al.

(10) Patent No.: US 11,117,369 B2
(45) Date of Patent: Sep. 14, 2021

(54) LIQUID EJECTION APPARATUS

(71) Applicant: Brother Kogyo Kabushiki Kaisha, Nagoya (JP)

(72) Inventors: Shin Hasegawa, Nagoya (JP); Yoshiharu Furuhata, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 80 days.

(21) Appl. No.: 16/750,156

(22) Filed: Jan. 23, 2020

(65) Prior Publication Data

US 2020/0238692 A1 Jul. 30, 2020

(30) Foreign Application Priority Data

Jan. 25, 2019 (JP) ..... JP2019-011608

(51) Int. Cl.
*B41J 2/165* (2006.01)
*B41J 2/045* (2006.01)

(52) U.S. Cl.
CPC ..... *B41J 2/04558* (2013.01); *B41J 2/0458* (2013.01)

(58) Field of Classification Search
CPC .... B41J 2002/16573; B41J 2002/16502; B41J 2/165; B41J 2/16505; B41J 2/16508; B41J 2/16588; B41J 2/16579; B41J 2/04571; B41J 2/04558
See application file for complete search history.

(56) References Cited

U.S. PATENT DOCUMENTS

| | | | |
|---|---|---|---|
| 6,343,846 | B1 | 2/2002 | Asano |
| 10,179,448 | B2 | 1/2019 | Saito |
| 2005/0104917 | A1 | 5/2005 | Shibata et al. |
| 2017/0282538 | A1 | 10/2017 | Saito |

FOREIGN PATENT DOCUMENTS

| | | | |
|---|---|---|---|
| JP | H07-304216 | A | 11/1995 |
| JP | H10-119320 | A | 5/1998 |
| JP | H10-244692 | A | 9/1998 |
| JP | 2003-011337 | A | 1/2003 |
| JP | 2005-145018 | A | 6/2005 |
| JP | 2006-334810 | A | 12/2006 |
| JP | 2010-173189 | A | 8/2010 |
| JP | 2013-129102 | A | 7/2013 |
| JP | 2017-177547 | A | 10/2017 |

*Primary Examiner* — Scott A Richmond
(74) *Attorney, Agent, or Firm* — Banner & Witcoff, Ltd.

(57) ABSTRACT

A liquid ejection apparatus includes: an ejection head; a head scanning mechanism; a controller; and a storage, wherein the controller is configured to: perform, in a case where viscosity of the liquid satisfies a first condition, a first printing process of: discarding the liquid at a discard position and then printing a partial image; perform, in a case where viscosity of the liquid does not satisfy the first condition, the controller performs a second printing process of: printing the partial image on the recording medium, without discarding the liquid; perform, a division process of dividing the image data corresponding to at least first one pass of the image data into a first division data and a second division data; and, in the second printing process, the controller controls to eject the liquid based on the first division data and eject the liquid based on the second division data.

14 Claims, 10 Drawing Sheets

LIQUID EJECTION APPARATUS

CROSS-REFERENCE TO RELATED APPLICATION

This application claims priority from Japanese Patent Application No. 2019-011608 filed on Jan. 25, 2019, the entire subject matter of which is incorporated herein by reference.

TECHNICAL FIELD

This disclosure relates to a liquid ejection apparatus which ejects liquid such as ink.

BACKGROUND

In the background art, there is a liquid ejection apparatus that ejects liquid such as ink and has a configuration as described in JP-A-2010-173189. This liquid ejection apparatus performs printing on a recording sheet by, while moving a carriage on which an ejection head is mounted in a main scanning direction, ejecting ink droplets from the ejection head. In addition, since the recording sheet is conveyed in a sub-scanning direction, printing can be performed on the entire surface of the recording sheet.

Also, the liquid ejection apparatus covers the nozzle surface of the ejection head with a cap during standby when printing is not being performed, thereby preventing the ink in the nozzle from being dried. However, when the nozzle surface is covered with a cap, the ink in the nozzle is gradually thickened. Therefore, in the background art, in a case where a new print job is executed from the standby state, the ink in the nozzles is discarded by flushing or the like, and printing is performed after refreshing the inside of the nozzles.

However, when flushing is performed for each print job, the amount of ink consumed except printing increases, and the amount of ink that can be used for printing decreases. On the other hand, the background art discloses a liquid ejection apparatus in which ink that is discarded by flushing in the background art is also used for printing. More specifically, the ink that is discarded by flushing in the background art has a higher viscosity than the ink used for printing. Therefore, the liquid ejection apparatus disclosed in the background art attempts to land inks at appropriate positions on a recording medium by varying the ejection timing of each ink.

However, since the viscosity of the ink cannot always be obtained accurately, it is difficult to determine an appropriate ejection timing. As a result, the quality of the printed image may be unexpectedly low. On the other hand, when there is an attempt to obtain a more accurate viscosity in order to determine an appropriate ejection timing, various sensors such as a temperature sensor and a humidity sensor are required, resulting in an increase in price.

SUMMARY

This disclosure provides a liquid ejection apparatus capable of suppressing an increase in the price of the apparatus, and suppressing deterioration in the quality of a printed image while reducing the amount of discarded liquid by refreshing of nozzles.

A liquid ejection apparatus of this disclosure includes: an ejection head having a nozzle surface in which a plurality of nozzles are opened; a cap that is configured to cover the nozzle surface; a head scanning mechanism that is configured to reciprocate the ejection head in a main scanning direction, the nozzle surface being able to move the ejection head between a standby position where the nozzle surface of the ejection head is capped by the cap and a discard position where the liquid is discarded from the nozzle of the ejection head; a medium conveying mechanism that is configured to convey a recording medium in a sub-scanning direction orthogonal to the main scanning direction; a controller; and a storage. The controller is configured to: perform, in a case where viscosity of the liquid satisfies a first condition, a first printing process of: moving the ejection head from the standby position; ejecting and discarding the liquid from the nozzle at the discard position; and then printing a partial image on the recording medium based on the image data; perform, in a case where viscosity of the liquid does not satisfy the first condition, the controller performs a second printing process of: moving the ejection head from the standby position; and then printing the partial image on the recording medium based on the image data, without discarding the liquid at the discard position; perform, a division process of dividing the image data corresponding to at least first one pass of the image data into a first division data and a second division data. In the second printing process, the controller controls to eject the liquid based on the first division data and, after the ejecting the liquid based on the first division data, eject the liquid based on the second division data.

According to this disclosure, it is possible to provide a liquid ejection apparatus capable of suppressing an increase in the price of the apparatus and suppressing deterioration in the quality of a printed image while reducing the amount of discarded liquid by refreshing of nozzles.

BRIEF DESCRIPTION OF DRAWINGS

The foregoing and additional features and characteristics of this disclosure will become more apparent from the following detailed descriptions considered with the reference to the accompanying drawings, wherein.

DESCRIPTION OF EMBODIMENTS

First Embodiment

A liquid ejection apparatus according to an embodiment of this disclosure will be described with reference to the drawings. In the following, an ink ejection apparatus for ejecting ink to a recording sheet will be described as an example of the liquid ejection apparatus.

Configuration of Liquid Ejection Apparatus

Figure 1:
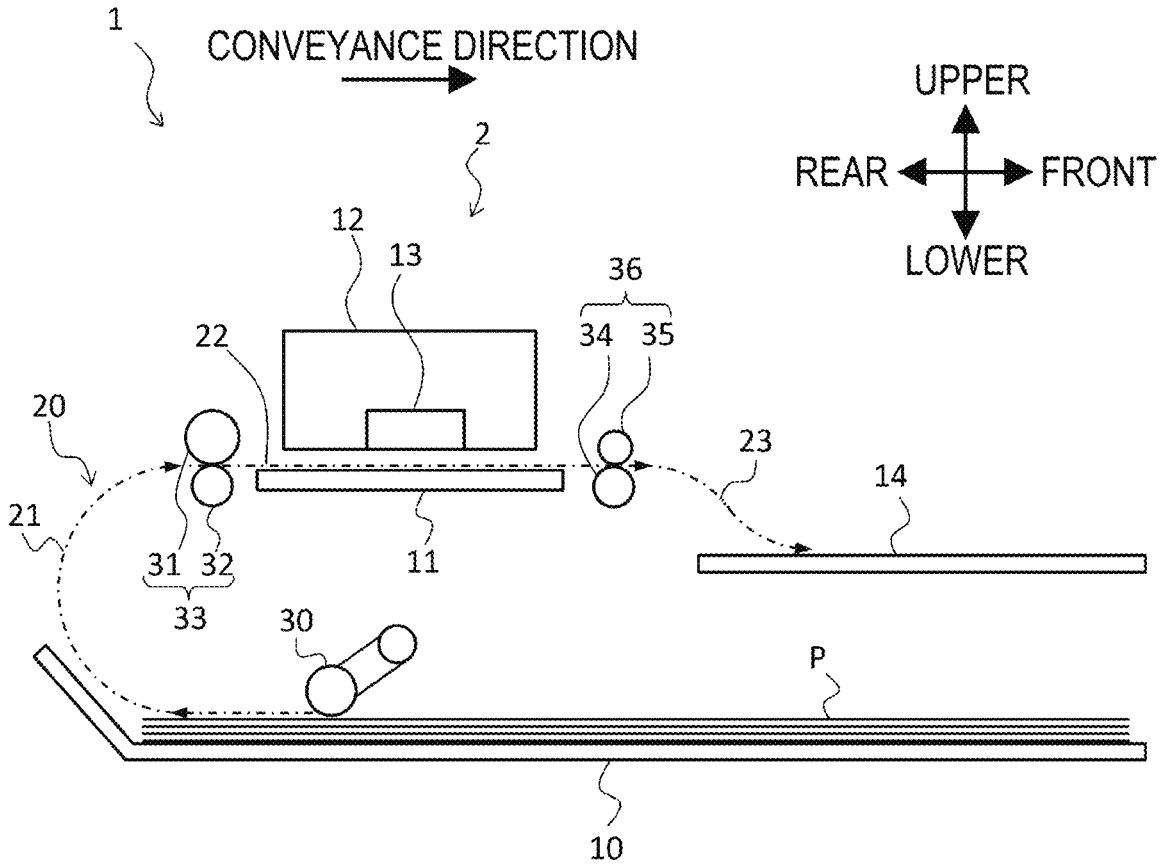
FIG. 1 is a schematic view showing a schematic configuration of a liquid ejection apparatus.

FIG. 1 is a schematic view showing a schematic configuration of a liquid ejection apparatus 1. In the liquid ejection apparatus 1, a sheet feeding tray 10, a platen 11, and a carriage 12 are assembled in order from the bottom. The sheet feeding tray 10 accommodates a plurality of recording sheets (recording media) P. Above the sheet feeding tray 10, the long platen 11 is provided in the left-right direction (corresponding to the main scanning direction) orthogonal to the paper surface. The platen 11 is a flat plate member and supports the recording sheet P conveyed in the conveyance direction (corresponding to the sub-scanning direction) from below. The carriage 12 is disposed further above the platen 11. The carriage 12 can reciprocate in the left-right direction, and is equipped with a liquid ejection head 13 and the like. In addition, a sheet discharge tray 14 is provided in front of the platen 11 (on the downstream side in the conveyance direction) to receive the recording sheet P that has been recorded.

A sheet conveying path 20 is provided to extend from the sheet feeding tray 10 to the sheet discharge tray 14. The sheet conveying path 20 can be divided into three paths (curved path 21, straight path 22, and end path 23). Among these, in the straight path 22, the recording sheet P is placed on the platen 11 and faces a recording head 13 through a predetermined interval.

The liquid ejection apparatus 1 includes a feeding roller 30, a conveyance roller 31, and a discharge roller 34 as a medium conveying mechanism for conveying the recording sheet P. Specifically, the feeding roller 30 is provided directly above the sheet feeding tray 10. The conveyance roller 31 is combined with a pinch roller 32 to constitute a conveyance roller unit 33, and is disposed near the downstream end of the curved path 21. The discharge roller 34 is combined with a spur roller 35 to constitute a discharge roller unit 36, and is disposed at the upstream side of the end path 23.

Here, when the medium conveying mechanism is driven, the recording sheet P is fed from the sheet feeding tray 10 to the curved path 21 by the feeding roller 30. The recording sheet P is placed on the platen 11 by the conveyance roller unit 33, and an image is formed by the liquid ejection head 13. The recorded recording sheet P is discharged to the sheet discharge tray 14 by the discharge roller unit 36.

The liquid ejection apparatus 1 includes the carriage 12, a guide member (not shown), and an endless belt (not shown) as a head scanning mechanism for reciprocating the liquid ejection head 13. The guide member includes two parallel support rods. The carriage 12 is slidably attached to the support rod. The endless belt is disposed parallel to the support bar and fixed to the carriage 12. When a carriage motor 51 (described later) rotates, the unsupported belt is traveled and the carriage 12 is also moved. At this time, the carriage 12 reciprocates in the left-right direction across the sheet conveying path 20.

Figure 2:
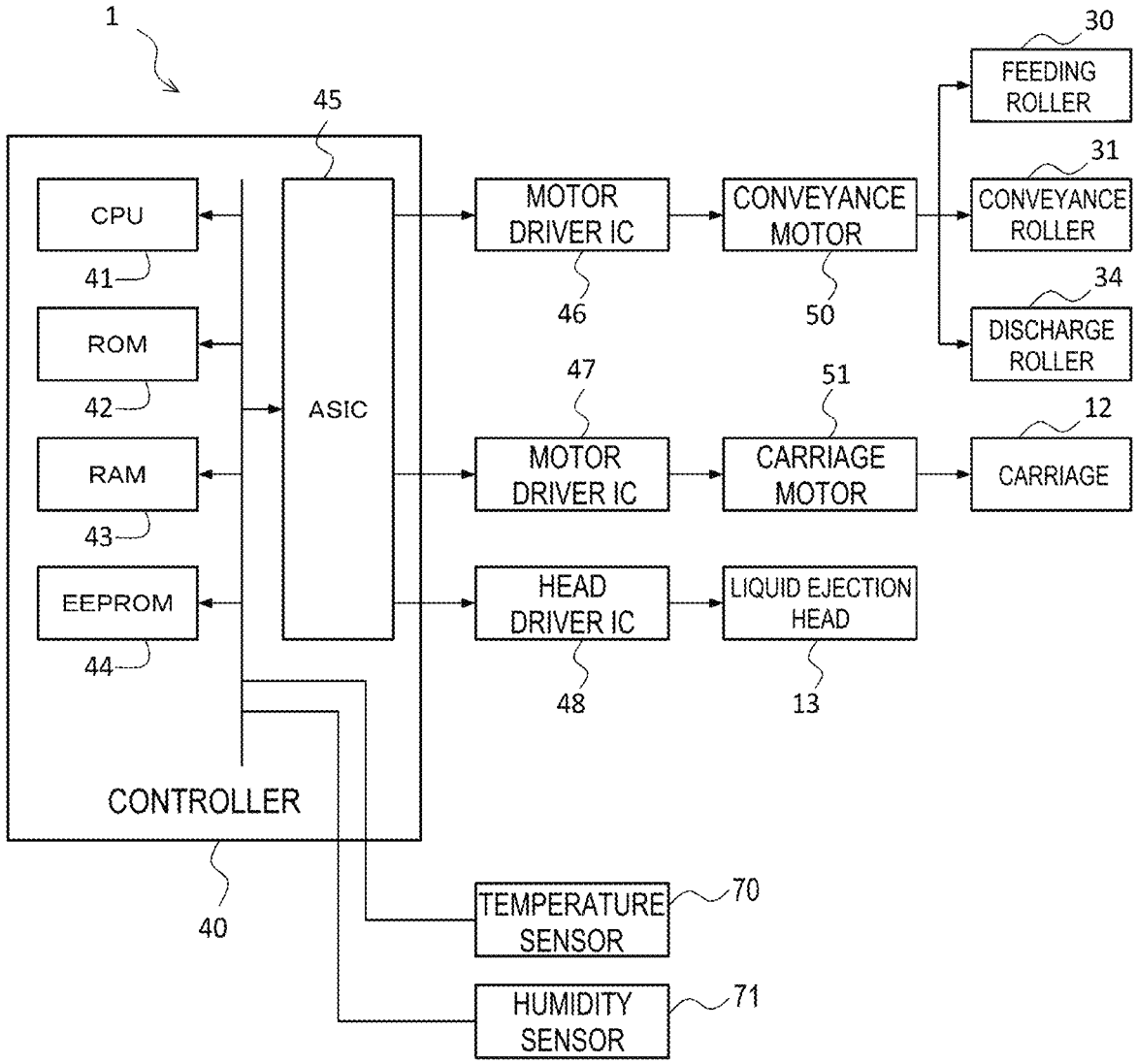
FIG. 2 is a block view showing a functional configuration of the liquid ejection apparatus.

FIG. 2 is a block view showing a functional configuration of the liquid ejection apparatus 1. A controller 40 of the liquid ejection apparatus 1 includes a first substrate and a second substrate, a CPU 41, a ROM 42, a RAM (storage) 43, and an EEPROM 44, which are connected by a bus, are mounted on the first substrate, and an ASIC45 is mounted on the second substrate. Two motor driver ICs 46 and 47 and a head driver IC 48 are connected to an ASIC 45. The motor driver IC 46 drives a conveying motor 50, and the motor driver IC 47 drives the carriage motor 51. The head driver IC 48 drives an actuator of the liquid ejection head 13.

When the controller 40 of the liquid ejection apparatus 1 receives a print command from a user or another communication device, the CPU 41 causes the RAM 43 to store image data related to the print command, and outputs various execution commands based on the program in the ROM 42 to the ASIC 45. The ASIC 45 controls each of the driver ICs 46 to 48 based on this command, and executes a printing process based on the image data in the RAM 43.

During the printing process, the motor driver IC 46 drives the conveying motor 50 and rotates the three rollers 30, 31, and 34. The motor driver IC 47 drives the carriage motor 51 to reciprocate the carriage 12 in the left-right direction. The head driver IC 48 drives the actuator to eject a vibration of the meniscus and the ink.

In addition, the liquid ejection apparatus 1 includes various sensors (for example, a tip detection sensor for a recording sheet, an encoder for the carriage and the conveyance roller 31, a temperature sensor 70, and a humidity sensor 71). The controller 40 controls the operation of each unit of the liquid ejection apparatus 1 based on signals from various sensors. For example, the controller 40 controls each of the above driver ICs 46 to 48 to perform the conveyance of the recording sheet P and the image formation at the same time. At this time, the controller 40 refers to the signals from the tip detection sensor and the encoder. Also, the controller 40 changes the form of image formation according to the viscosity of the liquid. At this time, the controller 40 refers to the signals from the temperature sensor 70 and the humidity sensor 71.

Figure 3:
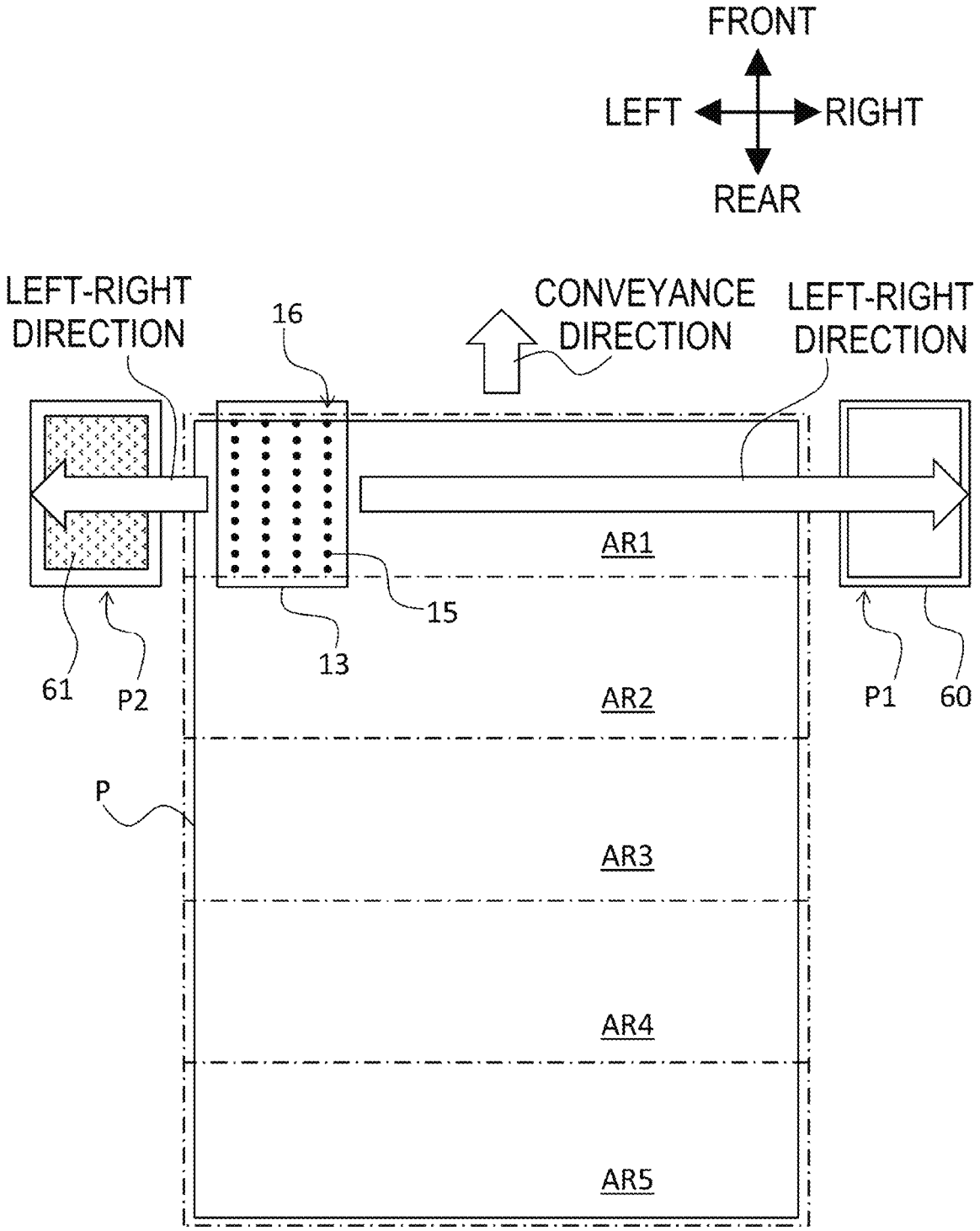
FIG. 3 is a diagram showing a recording sheet and a liquid ejection head when the liquid ejection apparatus is viewed from above.

FIG. 3 is a schematic diagram showing the operation of the liquid ejection head 13. The controller 40 alternately performs the reciprocating movement of the carriage 12 and the conveyance of the recording sheet P based on the print command. In a single reciprocation, one strip-shaped partial image is printed on the recording sheet P. In a single conveyance, the recording sheet P is moved in the conveyance direction by the width of the partial image. In this manner, the image is printed on the entire surface of the recording sheet P by repeating the printing of the partial image and the conveyance of the partial image by the width.

As an example, in the example shown in FIG. 3, five strip-shaped areas AR 1 to AR 5 are set. In the following, one strip-shaped area is also called "pass". In this case, the carriage 12 reciprocates five times in total, and prints partial images corresponding to each pass.

The bottom surface of the liquid ejection head 13 is a nozzle surface. A plurality of nozzles 15 are open on the nozzle surface. The plurality of nozzles 15 are aligned in the conveyance direction to constitute a nozzle array 16, and a plurality of (in this case, 4) nozzle arrays 16 are aligned in the left-right direction. Each nozzle row 16 corresponds to a different kinds of liquids.

In addition, the movement path of the carriage 12 reaches both sides of the conveyance area of the recoding sheet P. One end portion of the movement path (right end in FIG. 3) is a standby position P1, and the other end portion is a maintenance port P2. In the standby position P1, the liquid ejection head 13 is disposed when the power is turned off. The maintenance port P2 is provided with a form 61, and the liquid is discarded from the nozzle 15 (maintenance operation).

Operation Flow During Printing

Here, the liquid ejection apparatus 1 according to this disclosure realizes a long life of the form 61, effective use of liquid (improvement of liquid saving), and high speed printing by reducing the amount of liquid discarded in the maintenance operation (for example, purging and flashing). Specifically, in a case where the viscosity of the liquid satisfies a first condition (thickening level: high), the liquid ejection apparatus 1 performs the maintenance operation before printing (first printing process). On the other hand, in a case where the viscosity of the liquid does not satisfy the first condition (thickening level: low), the liquid ejection apparatus 1 does not perform the maintenance operation and divides the image (second printing process). Hereinafter, a more specific operation example of the liquid ejection apparatus 1 will be described with reference to the flowchart shown in FIG. 4.

First, the controller 40 receives a print command (S101). At this time, the carriage 12 is at the standby position P1, and the nozzle surface of the liquid ejection head 13 is covered with a cap 60. Subsequently, the controller 40 determines whether or not the status of the liquid ejection apparatus 1 is "ink saving mode" (S102). The "ink saving mode" is a printing mode that reduces ink consumption. This mode setting may be performed in advance using an operation panel of the liquid ejection apparatus 1 or the like. The mode information may be included in the print command. In this case, the controller 40 refers to the image data in the RAM 43 and determines the mode.

When the ink saving mode is selected (S102: YES), the controller 40 determines the liquid thickening level (S103). For example, the controller 40 acquires the environmental conditions from a temperature sensor 70 and a humidity sensor 71 and the elapsed time by a timer. Then, the controller 40 acquires the current viscosity (estimated value) of the liquid. The controller 40 determines the thickening level by comparing a threshold value and an estimated value T of the viscosity. In the embodiment, the controller 40 determines "high" (S103: NO) or "low" (S103: YES) with respect to a threshold value T1 of the estimated value.

In a case where the thickening level is "low" (S103: YES) (state that does not satisfy the first condition of this disclosure) (in a case where the first condition of this disclosure is not satisfied), the controller 40 further determines the level of duty for a first pass (S104). Here, the duty refers to the ratio of the amount of liquid actually supplied to the maximum amount of liquid that can be supplied by the liquid ejection apparatus 1 per unit area on the recording sheet P. The controller 40 determines "high" (S104: YES) or "low" (S104: NO) for a threshold value T2 based on the image data. In a case where the duty is "high" (S104: YES), the controller 40 performs a division printing process at the time of printing the first pass (S105).

In this case, even in the first pass, image formation is performed without maintenance (purging and flushing) of the liquid ejection head 13. In the division printing process, the controller 40 divides the partial image data corresponding to the first pass into two pieces (first division data and second division data). In the first pass, the first division image is formed in the forward path of the liquid ejection head 13, and the second division image is formed in the backward path. Of the two partial images, the former is formed based on the first division data and the latter is formed based on the second division data. The two partial images are combined and the partial image corresponding to the original partial image data is formed. Therefore, in the division printing process, the liquid ejection head 13 is scanned at least twice on the same pass.

In this manner, even when the viscosity is slightly increased, the liquid is used for image formation. The liquid is not discarded. During image formation, thickening is eliminated over time and image quality is restored. Correspondingly, since the high quality second division image is combined with the low quality first division image, it is possible to effectively suppress degradation in the image quality of the completed partial image. Further, it is possible to extend the life span of the form 61 and to realize effective liquid use and high speed printing.

In Step S105, such a division printing process is performed only in the first pass. Then, after the next pass, printing is performed without division (S106). This "printing without division" refers to a normal printing mode, and specifically, based on the partial image data, the controller 40 prints a partial image of the corresponding pass. In the partial image formation, the liquid ejection head 13 is scanned only once on the same pass.

Step S106 will be described in more detail. So far, the thickening level is determined to be "low" (S103: YES), and the duty is determined to be "high" (S104: YES). In this case, the progress of thickening is weak and high duty ejection is performed for image formation. Therefore, almost all of the thickened liquid is consumed by forming the first division image in the first pass. After the next pass, an image can be formed with the desired image quality even when printing is performed without division. Further, the printing speed can be increased.

On the other hand, in a case where the duty is "low" (S104: NO) in Step S104, the controller 40 performs a division printing process for all passes (S121). That is, although the progress of thickening is weak, low duty ejection is performed for image formation. The amount of liquid consumed is small. Therefore, even when the first pass is printed, there is a high possibility that the thickened liquid remains in the nozzle 15. Here, the controller 40 performs the division printing process for all the passes (S121).

Further, in Step S103, in a case where the thickening level is "high" (S103: NO) (in a case where the first condition of this disclosure is satisfied), the liquid ejection head 13 is subjected to maintenance. At this time, the controller 40 determines whether or not the waste liquid holding capacity of the form 61 has room (whether or not the form is full) (S111). For example, the EEPROM 44 stores an integrated amount of the discarded ink from starting of the liquid ejection apparatus 1, and the controller 40 determines whether or not the waste liquid holding capacity of the form 61 has room based on comparing the integrated amount with a threshold value, which is stored in the ROM 42 and represents a capacity of the form 61. Alternatively, the liquid ejection apparatus 1 may have a sensor to determine whether the form 61 has a room based on conductivity. In case where the form 61 has a room (S111: YES), the controller 40 performs flushing (FLS) of the liquid ejection head 13 before printing (S112). As a result, since the nozzle 15 is filled with fresh liquid, printing is performed without dividing all the passes (S113).

In contrast, in a case where the thickening level is "high" (S103: NO), there is no room in the form 61 (S111: NO), the controller 40 causes the process to proceed to Step S121.

Division printing is performed for all the passes. Thus, even when the liquid is thickened and the form 61 is full, printing is performed.

When the status of the liquid ejection apparatus 1 is the image quality mode that prioritizes image quality (S102: NO), the controller 40 causes the process to proceed to Step S111 without determining the liquid thickening level or the printing duty. That is, when there is room in the form 61 (S111: YES), the controller 40 performs flushing (S112) and then performs printing without division (normal printing process) for all the passes (S113). In addition, when there is no room in the form 61 (S111: NO), the controller 40 does not perform flashing and performs the division printing process for all the passes (S121).

Specific Example of Division Printing Process

However, in a case where the division printing process is performed, as described above, a liquid with higher viscosity than that of the fresh state is also used for printing. Accordingly, the liquid ejection apparatus 1 suppresses deterioration in image quality by devising the contents of the first division data and the second division data acquired from the partial image data as follows.

Figure 5:
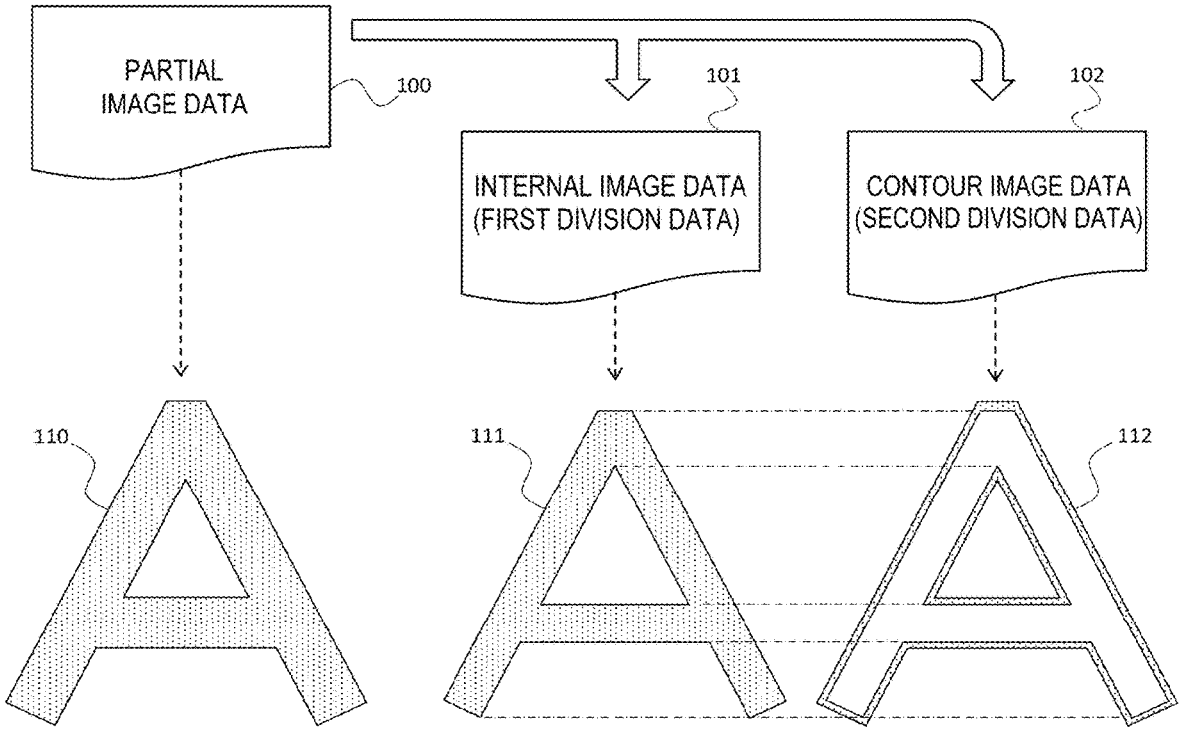
FIG. 5 is a schematic view for explaining an aspect of a division printing process of suppressing deterioration in image quality.

FIG. 5 is a schematic view for explaining an aspect of a division printing process. Here, for convenience, a printed partial image 110 is designated as a letter "A". The controller 40 divides a corresponding partial image data 100 into two pieces of data (contour image data 102 and internal image data 101). Of these, the contour image data 102 corresponds to a contour image 112 which is the contour portion of the letter "A", and is set as the second division data. On the other hand, the internal image data 101 corresponds to an internal image 111 which is the internal portion of the contour portion, and is set as the first division data.

In this case, the contour image 112 is printed following the internal image 111. Then, the two images 111 and 112 are combined to complete the letter "A". At this time, the internal image 111 is mainly formed of a thickened liquid. On the other hand, the contour image 112 is mainly formed of a fresh liquid. As a result, even when the image quality of the internal image 111 is slightly low, the contour image 112 can be printed with the original image quality. Therefore, deterioration in the image quality of the partial image 110 is suppressed.

Modification Example 1

Figure 6:
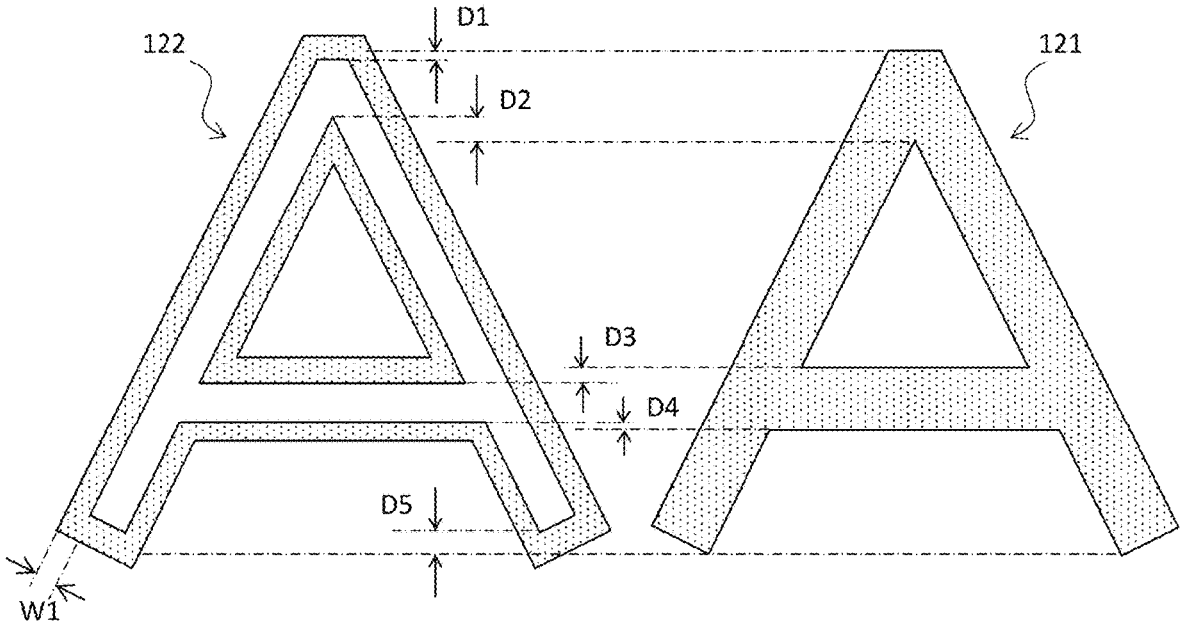
FIG. 6 is a schematic diagram for explaining a process of preventing the generation of a margin between an internal image and a contour image.

In addition, as the liquid thickening progresses, the contour of the internal image 111 is distorted. At this time, a margin (a gap where no liquid droplets land) is formed between the two images 111 and 112. In this modification example, as shown in FIG. 6, there is an overlap between the two images 121 and 122 (portion illustrated by D1 to D5 in FIG. 6). Specifically, the internal image 121 has the same dimension as the internal image 111 in FIG. 5. On the other hand, the contour image 122 has the same outer dimension as the contour image 112 in FIG. 5, but the width W1 of the contour portion is set to be larger than that of the contour image 112.

Thus, even in a case where the contour of the internal image 121 is disturbed, the contour portion of the internal image 121 is overcoated with the contour image 122, and disturbance is less noticeable. Accordingly, it is possible to further suppress the deterioration of the image quality of the partial image 110 printed by the division printing process.

In this manner, in the contour image 122, in a case of forming the contour portion thereof, the diameter dimension of the liquid droplet used may be the diameter dimension specified in the partial image data. Alternatively, the diameter dimension may be larger than the diameter dimension specified in the partial image data. In a case where the diameter dimension specified in the partial image data is originally the maximum diameter, the liquid droplet may be formed with the maximum diameter.

Modification Example 2

In addition, the contour of the internal image is different in disturbance in relation to the movement direction of the carriage 12. The disturbance of contour is noticeable in the contour extending in the conveyance direction. Here, with reference to the schematic diagram in FIGS. 7A and 7B, the handling of this problem will be described.

Figure 7A:
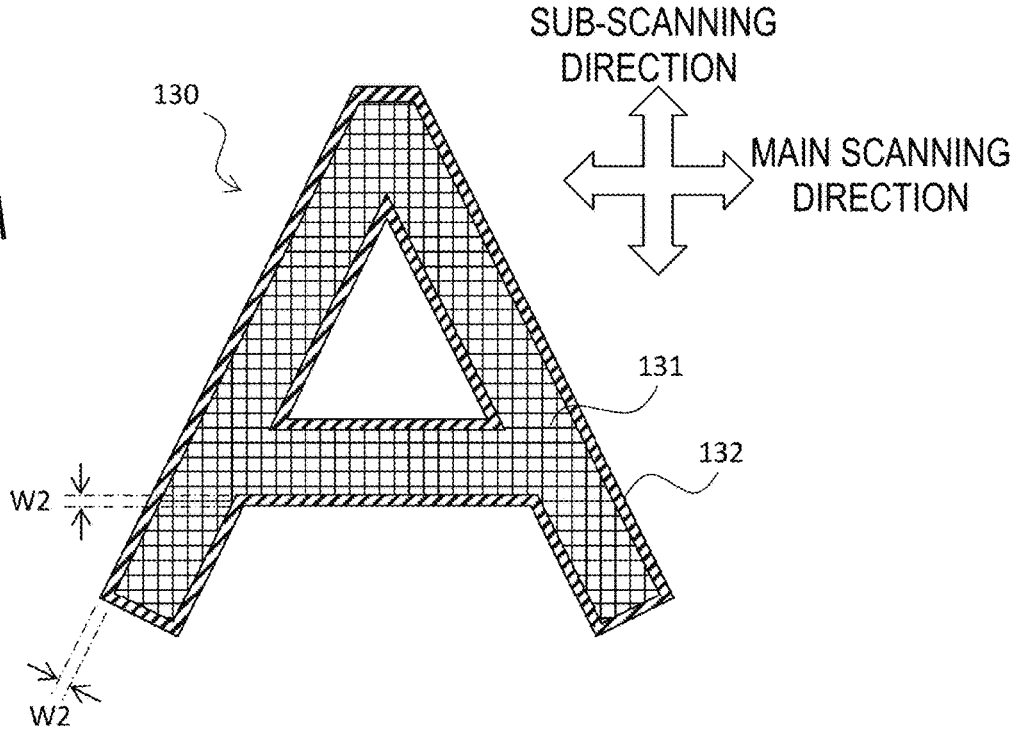
FIGS. 7A and 7B are schematic views for explaining a procedure of appropriately processing the disturbance of the contour of the internal image.

FIG. 7A is a comparative partial image 130, which is the same as the combined partial image 110 in FIG. 5. The width dimension of a contour image 132 is a constant value of W2 regardless of the direction in which the contour extends. In addition, in the partial image 130, in order to improve the visibility, an internal image 131 and the contour image 132 are provided with different hatchings.

Figure 7B:
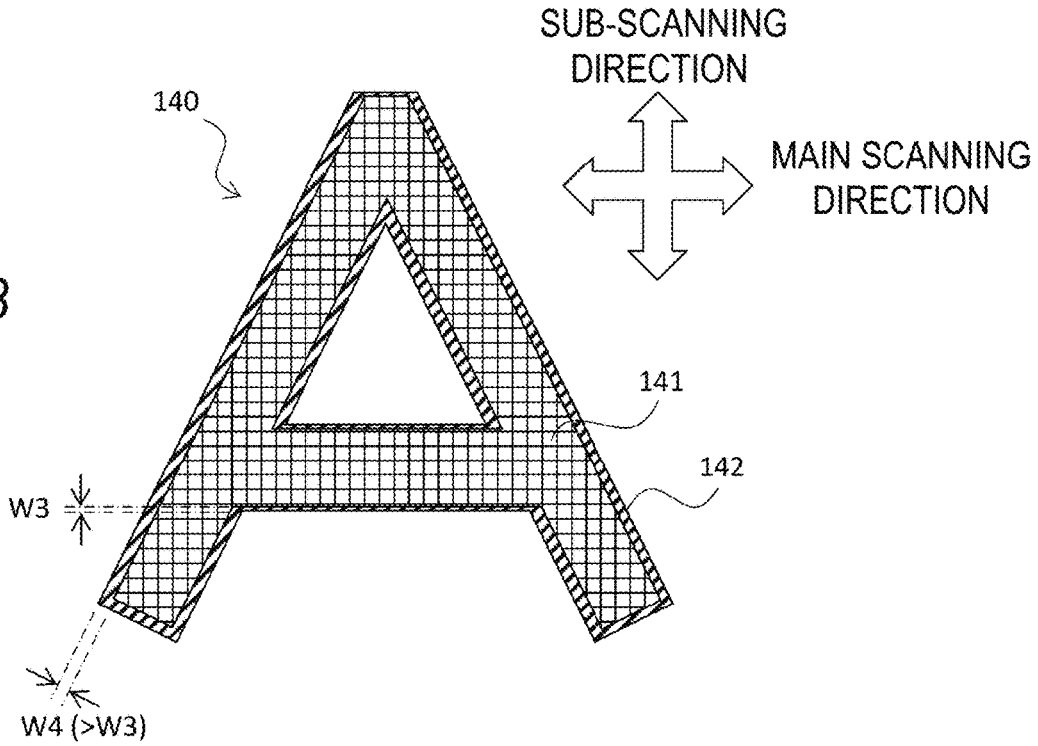

FIG. 7B shows a partial image 140 in the modification example. In the partial image 140, the width dimension W of the contour varies depending on the extending direction of a contour image 142. Specifically, the width dimension W4 of the contour extending in the conveyance direction is set to be larger than the width dimension W3 of the contour extending in the left-right direction.

In this manner, regarding the ease of disturbance of an internal image 141, the width dimension W of the contour image 142 is adjusted in consideration of the dependency of the extending direction thereof. The internal image 141 extending in the conveyance direction is easily disturbed and corresponds to the contour portion of the large width dimension W4. On the other hand, the internal image 141 extending in the left-right direction is not easily disturbed and corresponds to the contour portion of the small width dimension W3. At this time, the width of the corresponding portion of the internal image 141 is increased. In the portion where the width dimension W of the contour image 142 is small, the area of the internal image 141 is increased, so that the thickened liquid is replaced with a fresh liquid. Thus, the image quality of the internal image 141 can be quickly recovered while properly suppressing the disturbance.

Modification Example 3

Further, the speed of the liquid replacement described above varies depending on the size of the image. The larger the size, the larger the liquid consumption. Thus, the liquid replacement progresses and the image quality is quickly recovered. Here, with reference to the schematic diagram in FIGS. 8A and 8B, the handling of this problem will be described.

Figure 8A:
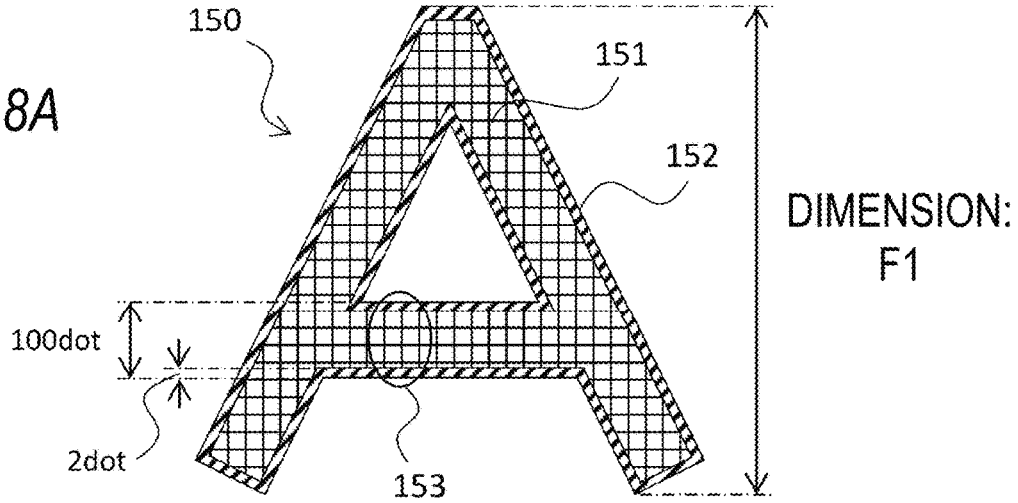
FIGS. 8A and 8B are schematic diagrams for explaining a method of setting the width dimension of the contour image when printing two identical characters of different sizes.
Figure 8B:
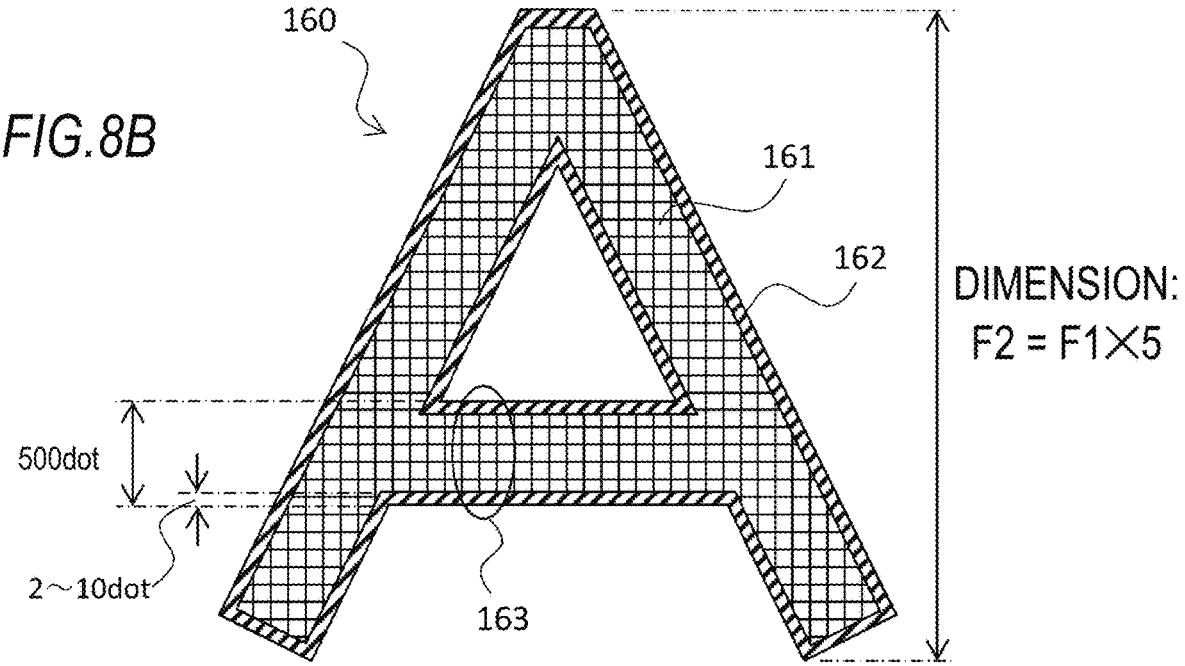

FIGS. 8A and 8B show two identical letters "A". The letter "A" (partial image 150) shown in FIG. 8A has a dimension F1. The letter "A" (partial image 160) shown in FIG. 8B has a dimension F2 (for example, F2=F1*5). Then, the two partial images 150 and 160 are similar. Therefore, in a case of comparing the width dimensions of the same portions, when the width dimension of the former is 100 dots, the width dimension of the latter is 500 dots.

Here, in the partial image 150 of FIG. 8A, the ratio of the width dimension of the contour image 152 to the width dimension of an arbitrary portion is 2%. For example, when the width dimension of this portion is 100 dots, the width dimension of the contour image 152 is 2 dots.

In this modification example, the ratio of the contour image 152 in the width dimension may be set to be smaller as the size of the image becomes larger. For example, in the partial image 160, when the ratio is the same as that of the partial image 150, the width dimension is 10 dots. However, the width dimension of this modification example may be less than 10 dots.

In this manner, the width dimension of the contour image is adjusted according to the size of the image. As the partial image becomes larger, the ratio of the area of the internal image to the area of the partial image also increases. Therefore, the consumption speed of the thickened liquid increases and the replacement with a fresh liquid is performed more quickly. A minimum value may be set for the width dimension of the contour image 162. At this time, this minimum value may be set by the ratio to the width dimension of a corresponding portion 163, or may be set by the number of dots. FIG. 8B shows an example of specifying the minimum value by the number of dots. In this case, the minimum value is 2 dots.

Modification Examples 1 to 3 above can be particularly suitably applied when the partial image is text (characters constituting a sentence) including any one of letters, numbers, codes, symbols, and icons.

Modification Example 4

Figure 9A:
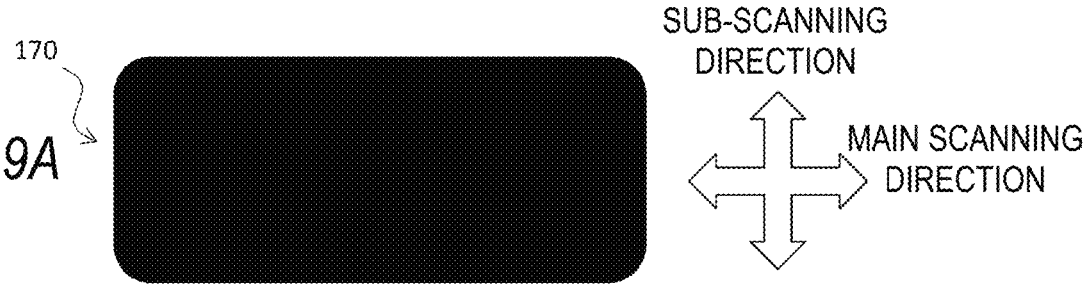
FIGS. 9A to 9C are schematic diagrams for explaining an aspect of a division printing process of suppressing deterioration in image quality when a partial image is non-text.
Figure 9B:
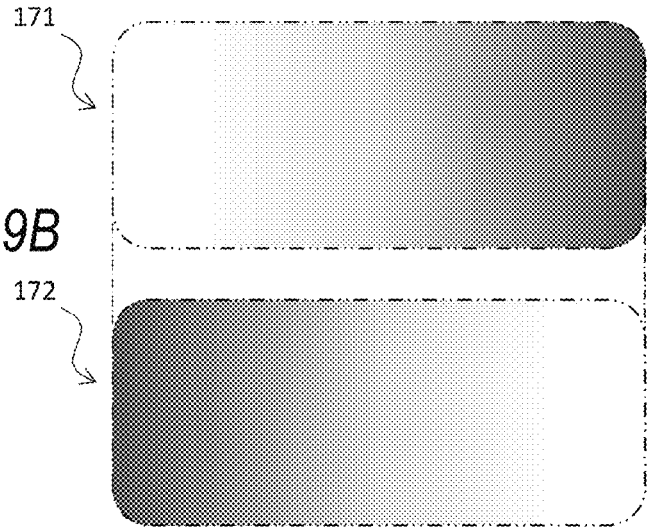
Figure 9C:
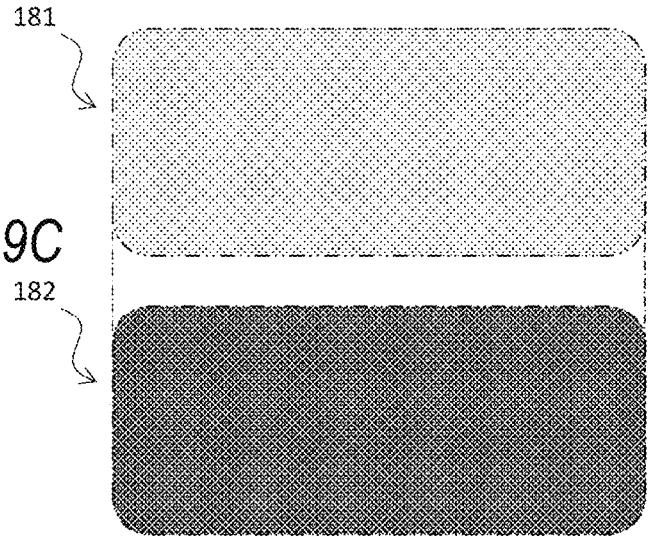

FIGS. 9A to 9C are schematic diagrams for specifically explaining an aspect of a division printing process of suppressing deterioration in image quality when a partial image is non-text. In FIGS. 9A to 9C, as a non-text partial image 170, an example of a solid image with a uniform density and a solid density formed in a substantially rectangular shape is shown (refer to FIG. 9A).

In the example shown in FIG. 9B, in a case where the partial printing process is performed on the partial image 170, the data obtained by dividing the partial image data into two pieces is acquired. One of the two pieces is the first division data corresponding to a first division image 171 in which the duty gradually increases with the progress of printing. The other is the second division image data corresponding to a second division image 172 to be combined with the first division image 171, and the first division image 171 and the second division image 172 are combined with each other to form the partial image 170. In other words, the second division data is data that complements the first division data with respect to the partial image data. In a case where the liquid ejection apparatus 1 is capable of performing printing in both directions and performs printing while folding back the recoding sheet after printing with the first division data, the second division data is data whose content of duty gradually increases with the progress of printing. In addition, in a case where the liquid ejection apparatus 1 is capable of performing printing in one direction, the second divided data is data whose content of duty gradually decreases with the progress of printing.

In the example shown in FIG. 9C, the first division data corresponding to a first division image 181 and the second division data corresponding to the second division image 182 are acquired from the partial image data. Among these, the first division image 181 is set to have a lower duty than the second division image 182.

In a case where the image to be printed by the division printing process is non-text, the first division data and the second division data set as shown in FIG. 9B or FIG. 9C can be used in the liquid ejection apparatus 1. Thus, even when printing is performed using a high viscosity liquid, it is possible to suppress deterioration in image quality. In FIGS. 9B and 9C, although a two-dot chain line is attached to the contour line of each division image, but this two-dot chain line is simply to clarify the shape of each division image and is not included in the image.

Second Embodiment

The liquid ejection apparatus 1 of the embodiment more finely controls the liquid thickening level and the duty of the pass (strip-shaped area) from the viewpoint of more effective life span of the form 61, effective liquid use, and high speed printing. Specifically, the number of pass to which division printing is applied is set in multiple stages. Thus, an increase in wasted printing time is suppressed while suppressing degradation in image quality. Since the configuration of the first embodiment (refer to FIGS. 1 to 3) can be applied to the configuration of the liquid ejection apparatus 1 of the embodiment, the description thereof is omitted here. Hereinafter, a more specific operation example of the embodiment will be described with reference to the flowchart shown in FIG. 10.

First, the controller 40 receives a print command (S201). At this time, the carriage 12 is at the standby position, and the nozzle surface is covered with the cap 60. Subsequently, the controller 40 determines the status of the liquid ejection apparatus 1 (S202).

In a case where the status is an ink saving mode (S202: YES), the controller 40 determines the liquid thickening level (S203). At this time, the thickening level is determined in three stages ("low", "medium", and "high"). More specifically, the controller 40 has two threshold values T3 and T4 for the thickening level. The controller 40 determines that when the acquired liquid viscosity is less than the threshold value T3, the thickening level is "low", when the viscosity is equal to or more than the threshold value T3 and less than T4 (>T3), the thickening level is "medium", and when the viscosity is equal to or more than the threshold value T4, the thickening level is "high".

In a case where the thickening level is "low" (S203: YES) (in a case where the first condition of this disclosure is not satisfied), further, the controller 40 determines the degree of duty for the first pass (S204). At this time, the duty is also determined in three stages ("low", "medium", and "high"). More specifically, the controller 40 has two threshold values T5 and T6 for the duty. The controller 40 determines that when the acquired duty is equal to or more than the threshold value T6, the duty is "high", when the duty is less than the threshold value T6 and equal to or more than T5 (<T6), the duty is "medium", and when the duty is less than the threshold value T5, the duty is "low".

As a result, when the duty is "high" (S204: YES), the controller 40 performs a division printing process in the first pass (S205). The division printing process is the same as in the first embodiment. In this manner, the liquid with a low viscosity level is used for printing without being discarded. It is possible to expand the life span of the form 61 and realize effective liquid use.

In Step S205, the controller 40 performs a division printing process in the first pass. Printing after the next pass is printing without division (S206). In this manner, the application of division printing is limited to the first pass. Therefore, it is possible to perform high speed printing.

On the other hand, in Step S204, in a case where the controller 40 determines that the duty of the first pass is not "high" (S204: NO), the following pass is added and the duty level is determined (S222). As a result, in a case where the duty level is other than "low" (S222: YES), the controller 40 performs a division printing process in two passes (S223). The remaining pass printing is printing without division (S224). That is, since the duty of the first pass is not high, the next pass is added to replace the thickened liquid with a fresh liquid. At this time, the first two passes are the targets of division printing.

Further, in Step S222, in a case where the duty of the first two passes is "low" (S222: NO), the controller 40 performs a division printing process for all the passes (S232). That is, in a case where the duty of the first two passes is low, the controller 40 determines that there is a high possibility that the thickened liquid remains in the inside of the nozzle 15 even when the two passes are subjected to division printing. Therefore, the controller 40 targets all the passes for the division printing process.

In addition, in Step S203, in a case where it is determined that the thickening level is not "low" (the condition that satisfies the first condition according to this disclosure) (S203: NO), basically, maintenance is applied to the liquid ejection head 13. At this time, the controller 40 determines whether or not the waste liquid holding capacity of the form 61 is sufficient (is not full) (S211). For example, the EEPROM 44 stores an integrated amount of the discarded ink from starting of the liquid ejection apparatus 1, and the controller 40 determines whether or not the waste liquid holding capacity of the form 61 has room based on comparing the integrated amount with a threshold value, which is stored in the ROM 42 and represents a capacity of the form 61. Alternatively, the liquid ejection apparatus 1 may have a sensor to determine whether the form 61 has a room based on conductivity. In case where the form 61 has a room (S211: YES), the controller 40 performs flushing (FLS) of the liquid ejection head 13 before printing (S212). As a result, the nozzle 15 is filled with a fresh liquid, and thus printing without division is performed for all the passes (S213).

In contrast, in Steps S203 and S211, in a case where the thickening level is not "low" (S203: NO) and in a case where there is no room in the form 61 (S211: NO), the controller 40 determines whether or not the thickening level is "medium" (S221). As a result, in a case where the thickening level is "medium" (S221: YES), the controller 40 performs processes after Step S222 described above. On the other hand, when it is determined that the thickening level is not "medium" (that is, the thickening level is "high") (S221: NO), the controller 40 performs the process of Step S232 described above.

Also, in a case where the status of the liquid ejection apparatus 1 is the image quality mode that prioritizes image quality (S202: NO), the controller 40 causes the process to proceed to Step S211 without determination of the liquid thickening level or the printing duty. The following is as described above.

As described above, in the liquid ejection apparatus 1 according to the second embodiment, the controller 40 determines the number of target passes (target strip-shaped areas) for the division printing process based on the thickening level (viscosity information) and the duty for each pass. (Steps S205, S223, and S232). More specifically, as the thickening level becomes higher or as the duty becomes lower, the number of target passes increases. Thus, a more appropriate number of passes can be targeted for the division printing process, and the balance between improvement of liquid saving properties and speeding up of the printing process can be optimized.

Other Embodiments

Hereinafter, other embodiments that can be replaced or added to the above-described first or second embodiment will be described.

Operation Flow

Figure 4:
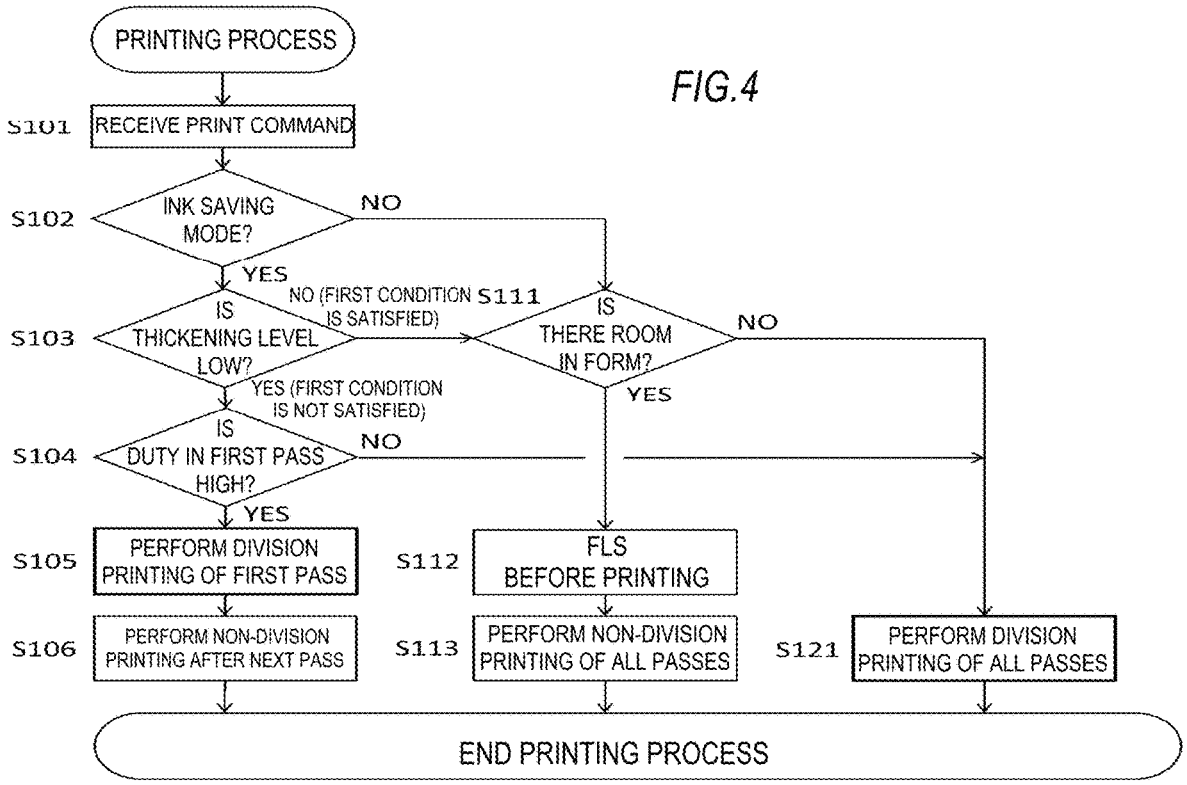
FIG. 4 is a flowchart showing an operation in a case where a liquid ejection apparatus executes a print command.
Figure 10:
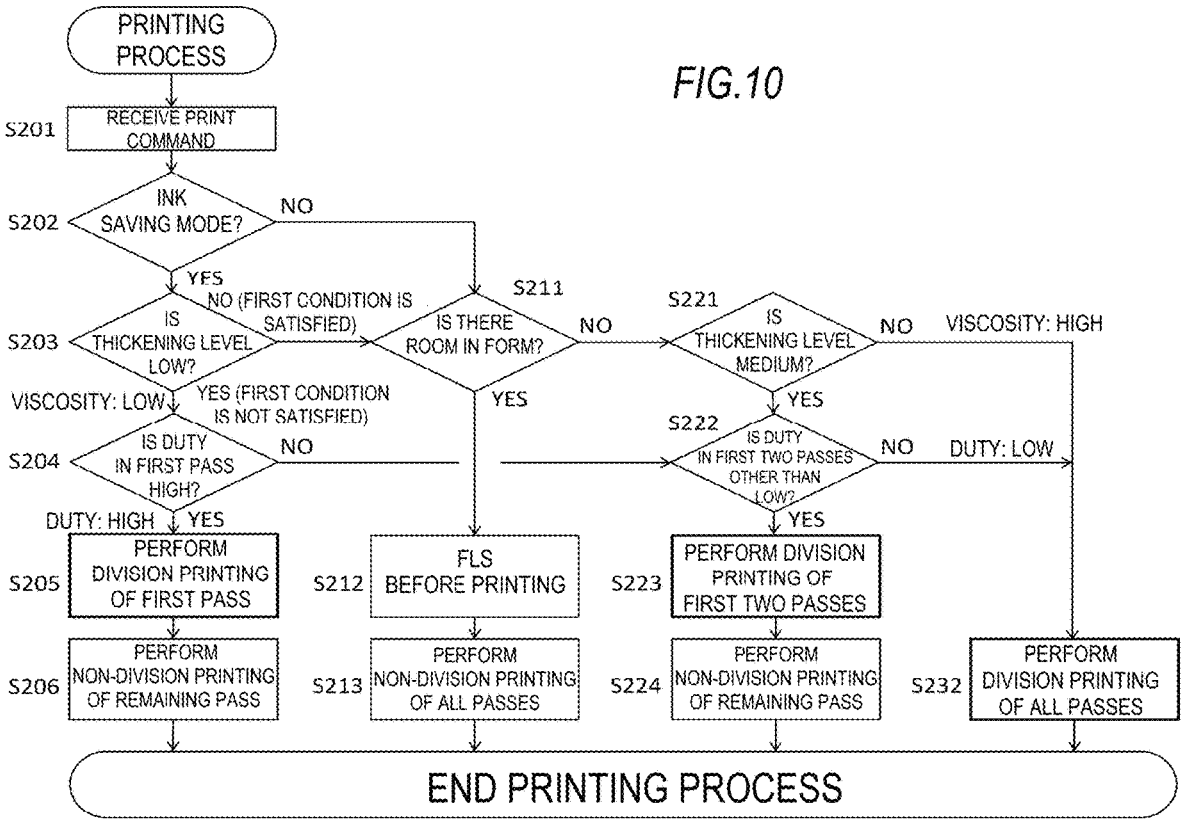
FIG. 10 is a flowchart showing another operation when the liquid ejection apparatus executes a print command

In the examples shown in FIGS. 4 and 10, after the mode is determined (S102 and S202), the thickening level is determined (S103 and S203) or the room of the form 61 is determined (S111 and S211). When there is room in the form 61, the controller 40 performs the first printing process. That is, printing without division (S113 and S213) is performed while performing flushing (S112 and S212) at the discard position P2. However, the operation mode of the liquid ejection apparatus 1 is not limited thereto.

For example, when the controller receives a print command (S101 and S201), first, the controller 40 determines the room of the form 61 (S111 and S211) and in a case where there is room in the form, the thickening level may be determined. Then, in a case where the thickening level is high, the controller 40 may perform the first printing process, and in a case where the thickening level is low, the controller may perform the second printing process. On the other hand, in a case where there is no room in the form 61, the controller 40 may perform the second printing process.

Non-Ejection Vibration Process

In addition, the liquid ejection apparatus 1 can execute a non-ejection vibration process of vibrating the liquid in a non-ejection state for the purpose of suppressing the thickening of the liquid. Information such as a voltage waveform required for the non-ejection vibration process is recorded in the ROM 42. In addition the non-ejection vibration process includes a first non-ejection vibration process and a second non-ejection vibration process, and information such as a voltage waveform is recorded in the ROM 42. In the first non-discharge vibration process, the pressure applied to the liquid in the nozzle 15 is relatively small. On the other hand, in the second non-discharge vibration process, this pressure is relatively large.

Then, when the print command is received (S101 and S201), the operation shown in FIG. 4 or FIG. 10 is executed. In parallel with this operation, the non-discharge vibration process is also executed. At this time, when receiving the print command, the controller 40 first executes the second non-ejection vibration process. Thus, the liquid is vibrated the extent that the thickened liquid is not ejected and refreshing of the liquid in the nozzle 15 is promoted.

Thereafter, the controller 40 switches from the second non-ejection vibration process to the first non-ejection vibration process at a predetermined timing based on the information on the thickening level and the duty while executing the second non-ejection vibration process. That is, in the processes of FIGS. 4 and 10 executed in parallel at the same time, the liquid in nozzle 15 is refreshed according to the mode determined based on the thickening information and the duty information. In addition, based on the thickening information and the duty information, it is possible to predict when the liquid in the nozzle 15 is refreshed.

Thus, in the second non-ejection vibration process, the freshness restoration of the liquid in nozzle 15 can be promoted by large vibration. The early end of the second non-ejection vibration process can suppress an increase in power consumption, suppress the shortening of the life span of the actuator, and suppress the heat generation of the actuator. In addition, during printing, since the first non-ejection vibration process is executed instead of the second non-ejection vibration process, the thickening of the liquid in the nozzle 15 during printing can also be suppressed.

In a case where the drive waveform of the actuator is the same, the delay in liquid ejection timing increases as the viscosity increases. Accordingly, it is preferable that the ejection timing is set to be early according to the thickening information and the period when the ejection timing is early is shortened according to an increase in the ejection amount of the liquid.

Tricolor Printing

However, the liquid ejection apparatus 1 is configured to eject tricolor liquids such as magenta, cyan, and yellow in addition to black. When the tricolor liquids are landed on the same spot, a black dot can be synthesized. Therefore, instead of ejecting the black ink, the black dot may be synthesized by landing each tricolor liquid on the black ink at the expected landing position on the recording sheet P. Particularly, in a case where the color liquid is thickened and there are dots of black ink in the image to be printed, the dots may be synthesized with the tricolor liquids instead of the black ink. Thus, the thickened tricolor liquids are consumed in the image formation and thus can be replaced with fresh liquids without deterioration in the overall image quality.

This disclosure can be applied to a liquid ejection apparatus that ejects a liquid such as ink.

What is claimed is:

1. A liquid ejection apparatus comprising:

an ejection head having a nozzle surface in which a plurality of nozzles are opened;

a cap that is configured to cover the nozzle surface;

a head scanning mechanism that is configured to reciprocate the ejection head in a main scanning direction, the nozzle surface being able to move the ejection head between a standby position where the nozzle surface of the ejection head is capped by the cap and a discard position where liquid is discarded from a nozzle of the ejection head;

a medium conveying mechanism that is configured to convey a recording medium in a sub-scanning direction orthogonal to the main scanning direction;

a controller; and a storage, wherein the controller is configured to:

perform, in a case where viscosity of the liquid satisfies a first condition, a first printing process of: moving the ejection head from the standby position; ejecting and discarding the liquid from the nozzle at the discard position; and then printing a partial image on the recording medium based on image data;

perform, in a case where viscosity of the liquid does not satisfy the first condition, a second printing process of: moving the ejection head from the standby position; and then printing the partial image on the recording medium based on the image data, without discarding the liquid at the discard position; and perform, a division process of dividing the image data corresponding to at least first one pass of the image data into a first division data and a second division data, wherein, in the second printing process, the controller ejects the liquid based on the first division data and, after the ejecting the liquid based on the first division data, ejects the liquid based on the second division data.

2. The liquid ejection apparatus according to claim 1, wherein the first division data is contour image data corresponding to a contour portion an image corresponding to the image data, and wherein the second division data is an internal image data corresponding to a portion inside the contour portion of the partial image.

3. The liquid ejection apparatus according to claim 2, wherein a diameter dimension of liquid droplets based on the contour image data is equal to or more than a diameter dimension determined by the image data.

4. The liquid ejection apparatus according to claim 2, wherein a width dimension of a portion extending in the sub-scanning direction of the contour portion is larger than a portion extending in the main scanning direction of the contour portion.

5. The liquid ejection apparatus according to claim 2, wherein, in images having different sizes and similar shapes to each other, as a size of an image is larger, a width dimension of the contour portion occupying a width dimension of an image is smaller.

6. The liquid ejection apparatus according to claim 1, wherein in the second printing process, the controller sets the first division data of the divided image data such that a duty, which is a ratio of a liquid amount supplied per unit area on the recording medium, gradually increases with progress of printing based on the first division data.

7. The liquid ejection apparatus according to claim 1, wherein in the second printing process, a duty, which is a ratio of a liquid amount supplied per unit area on the recording medium, of the first division data is lower than a duty of the second division data.

8. The liquid ejection apparatus according to claim 1, wherein the controller is configured to receive an image quality mode setting that prioritizes image quality over liquid saving, and a liquid saving mode setting that prioritizes liquid saving over image quality, and wherein when the image quality mode setting is received, the controller executes the first printing process, and when the liquid saving mode setting is received, the controller executes the second printing process.

9. The liquid ejection apparatus according to claim 1, wherein the controller performs a determination process of determining whether a liquid saving mode setting, in which a consumption of the liquid is saved, is used, and wherein when it is determined that the liquid saving mode setting is used, the controller performs the second printing process.

10. The liquid ejection apparatus according to claim 1, wherein the controller is configured to determine whether or not the liquid can be further discarded at the discard position, and wherein when the liquid can be further discarded at the discard position, the controller executes one of the first printing process and the second printing process, and when the liquid cannot be further discarded at the discard position, the controller executes the second printing process.

11. The liquid ejection apparatus according to claim 1, wherein the controller determines a number of passes in the second printing process based on viscosity information indicating viscosity of a liquid in a nozzle and duty information indicating a duty for each of the passes, which is a ratio of a liquid amount supplied per unit area on the recording medium.

12. The liquid ejection apparatus according to claim 11, wherein as the viscosity of the liquid in the nozzle indicated by the viscosity information increases or the duty of a strip-shaped area indicated by the duty information decreases, the controller performs determination such that the number of passes increases.

13. The liquid ejection apparatus according to claim 1, wherein the controller is configured to execute a non-ejection vibration process of vibrating the liquid in a nozzle in a non-ejection state when the liquid is not ejected during execution of printing instructed by a print command, and the non-ejection vibration process includes a first non-ejection vibration process and a second non-ejection vibration process in which pressure to be applied to the liquid in the nozzle is larger than in the first non-ejection vibration process, and when the print command is received, the controller determines a timing of ending the second non-ejection vibration process and starting execution of the first non-ejection vibration process based on viscosity information indicating viscosity of the liquid in the nozzle and duty information indicating a duty for each of strip-shaped areas, which is a ratio of a liquid amount supplied per unit area on the recording medium, while executing the second non-ejection vibration process.

14. The liquid ejection apparatus according to claim 1, wherein the ejection head is configured to eject a black ink and a color ink, and in the second printing process, the controller synthesizes a black dot by landing a plurality of the color inks at an expected landing position of the black ink on the recording medium instead of ejection of a black ink based on the first division data.

* * * * *